US007980896B1

(12) United States Patent
Morgan

(10) Patent No.: US 7,980,896 B1
(45) Date of Patent: Jul. 19, 2011

(54) ELECTRICAL CONNECTOR ASSEMBLY

(75) Inventor: Chad William Morgan, Woolwich Township, NJ (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/851,344

(22) Filed: Aug. 5, 2010

(51) Int. Cl.
*H01R 13/648* (2006.01)

(52) U.S. Cl. ..... 439/607.05; 439/108

(58) Field of Classification Search ..... 439/79, 439/65, 75, 751, 752, 108, 607.05, 941, 607.7
See application file for complete search history.

(56) References Cited

U.S. PATENT DOCUMENTS

| | | | | |
|---|---|---|---|---|
| 5,543,586 | A | 8/1996 | Crane, Jr. et al. | |
| 7,331,802 | B2 * | 2/2008 | Rothermel et al. | 439/108 |
| 2007/0169961 | A1 | 7/2007 | Kwong et al. | |
| 2008/0207015 | A1 | 8/2008 | Sueyoshi | |

* cited by examiner

*Primary Examiner* — Javaid Nasri

(57) ABSTRACT

An electrical connector assembly includes a circuit board having signal vias extending at least partially through the circuit board, with the signal vias being arranged in pairs. The signal vias within the pair are open to each other through the circuit board and the circuit board has mounting pads exposed within the signal vias. An electrical connector is mounted on the circuit board. The electrical connector includes signal terminals extending into respective signal vias of the circuit board that are terminated to corresponding mounting pads. The signal terminals are arranged in pairs carrying differential pair signals. The signal terminals within the pair are arranged along a paddle supporting the signal terminals. The paddle is received in both signal vias of the corresponding pair of signal vias.

20 Claims, 4 Drawing Sheets

ELECTRICAL CONNECTOR ASSEMBLY

BACKGROUND OF THE INVENTION

The subject matter described and/or illustrated herein relates generally to electrical connector assemblies and, more particularly, to electrical connectors that are mounted on circuit boards.

To meet digital multi-media demands, higher data throughput is often desired for current digital communications equipment. Electrical connectors that interconnect circuit boards must therefore handle ever increasing signal speeds at ever increasing signal densities. One application environment that uses such electrical connectors is in high speed, differential electrical connectors, such as those common in the telecommunications or computing environments. In a traditional approach, two circuit boards are interconnected with one another in a backplane and a daughter board configuration. However, at the footprints of the circuit boards where the electrical connectors connect thereto it may be difficult to improve density while maintaining electrical performance and/or reasonable manufacturing cost. For example, vias within the circuit boards must be large enough to plate for a given circuit board thickness, but must also be far enough apart from one another to maintain electrical performance (e.g., impedance and/or noise). To increase the number of vias, and therefore increase the density of the circuit board footprint, the vias can be smaller and/or closer together. However, moving the vias closer together degrades the electrical performance of the circuit board footprint, while decreasing the size of the vias may increase manufacturing costs by increasing the difficulty of plating the vias. Circuit board footprints are currently a bottleneck for achieving higher system densities and/or higher system speeds.

Different known approaches have been used to improve the electrical performance and/or density of circuit board footprints. For example, careful via placement, anti-pad optimization, and counter boring of via stubs have been used to improve circuit board footprints. However, to achieve higher system densities and speed, further improvement of circuit board footprints and connections to the circuit boards must be made over known approaches.

There is a need for an electrical connector that enables improvement of the density and/or electrical performance of circuit board footprints to achieve higher system densities and/or higher system speeds.

BRIEF DESCRIPTION OF THE INVENTION

In one embodiment, an electrical connector assembly is provided including a circuit board having signal vias extending at least partially through the circuit board, with the signal vias being arranged in pairs. The signal vias within the pair are open to one another through the circuit board and the circuit board has mounting pads exposed within the signal vias. An electrical connector is mounted on the circuit board. The electrical connector includes signal terminals extending into respective signal vias of the circuit board that are terminated to corresponding mounting pads. The signal terminals are arranged in pairs carrying differential pair signals. The signal terminals within the pair are arranged along a paddle supporting the signal terminals. The paddle is received in both signal vias of the corresponding pair of signal vias.

In another embodiment, an electrical connector assembly is provided that includes a circuit board having signal vias extending at least partially through the circuit board. The signal vias are arranged in pairs. The circuit board has intermediate vias extending at least partially through the circuit board that are positioned between the signal vias within a corresponding pair. The intermediate via is open to both signal vias within the corresponding pair of signal vias and the pair of signal vias and the corresponding intermediate via define a via set. The circuit board has mounting pads exposed within the signal vias. An electrical connector is mounted on the circuit board. The electrical connector includes signal terminals extending into respective signal vias of the circuit board that are terminated to corresponding mounting pads. The signal terminals are arranged in pairs carrying differential pair signals with the pair of signal terminals being arranged along a paddle supporting the signal terminals. The paddle is received in both signal vias and the intermediate via of the corresponding via set.

In a further embodiment, an electrical connector assembly is provided including a circuit board having signal vias extending at least partially through the circuit board. The signal vias are arranged in pairs and have plated sections. The circuit board has mounting pads electrically connected to the plated sections. The circuit board has intermediate vias extending at least partially through the circuit board, wherein the intermediate vias are positioned between the signal vias within a corresponding pair. The intermediate via provides an air pocket between the plated sections of the signal vias within the corresponding pair of signal vias.

DETAILED DESCRIPTION OF THE INVENTION

Figure 1:
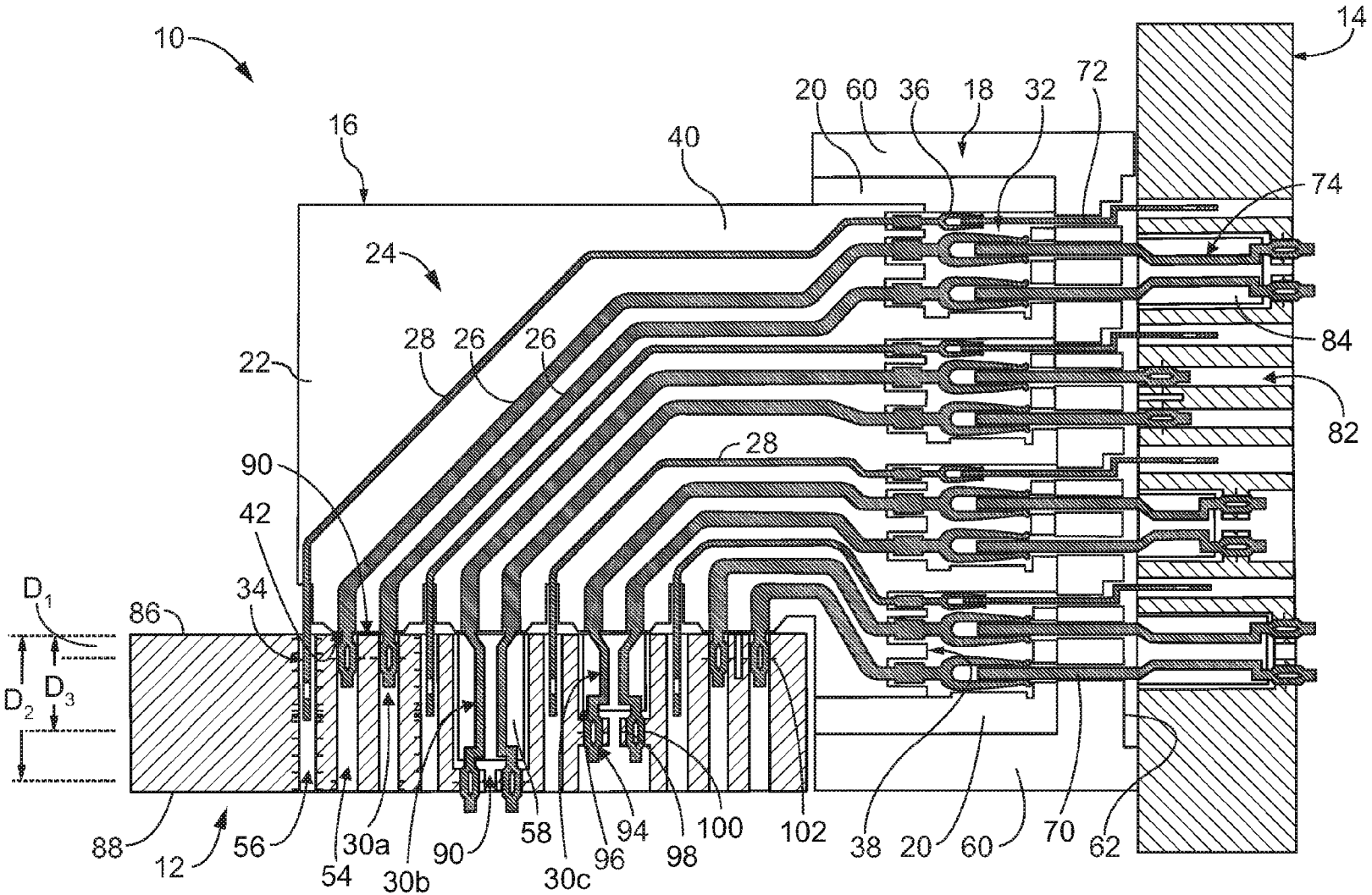
FIG. 1 is a cross-sectional view of an exemplary embodiment of an electrical connector assembly illustrating electrical connectors mounted to circuit boards.

FIG. 1 is a cross-sectional view of an exemplary embodiment of an electrical connector assembly 10. The connector assembly 10 includes a pair of circuit boards 12 and 14, a receptacle connector 16, and a header connector 18. The receptacle connector 16 is mounted on the circuit board 12, and the header connector 18 is mounted on the circuit board 14. The receptacle connector 16 and the header connector 18 are connected together to electrically connect the circuit boards 12 and 14. In the exemplary embodiment of FIG. 1, the receptacle connector 16 and the header connector 18 are oriented such that the connectors 16 and 18 form an approximate right-angle connection between the circuit boards 12 and 14. Alternatively, the receptacle connector 16 and the header connector 18 may be oriented such that the circuit boards 12 and 14 are oriented at any other angle relative to each other, such as, but not limited to, approximately parallel.

The subject matter herein may be described with reference to either the circuit board 12 or the circuit board 14, however it is realized that features or elements described relative to one of the circuit boards 12 or 14 may apply equally to the other circuit board 12 or 14. Similarly, the subject matter herein may be described with reference to either the receptacle connector 16 or the header connector 18, however it is realized that features or elements described relative to one of the receptacle connector 16 or the header connector 18 may apply equally to the other of the receptacle connector 16 or the header connector 18.

The receptacle connector 16 includes a dielectric housing 20 that, in the illustrated embodiment, holds a plurality of parallel contact modules 22 (one of which is illustrated in FIG. 1). The contact module 22 includes a contact lead frame 24 that includes a plurality of signal terminals 26 and/or a plurality of ground terminals 28. Each signal terminal 26 includes a mounting contact 30 at one end portion of the signal terminal 26 and a mating contact 32 at an opposite end portion of the signal terminal 26. Similarly, each ground terminal 28 includes a mounting contact 34 at one end portion of the ground terminal 28 and a mating contact 36 at an opposite end portion of the ground terminal 28. The mating contacts 32 and 36 extend outward from, and along, a mating face 38 of the contact module 22. The signal terminals 26 are optionally arranged in differential pairs.

Each contact module 22 includes a dielectric contact module housing 40 that holds the corresponding lead frame 24. Each contact module housing 40 includes the mating face 38 and a mounting face 42. In the illustrated embodiment, the mating face 38 is approximately perpendicular to the mounting face 42. However, the mating face 38 and mounting face 42 may be oriented at any other angle relative to each other, such as, but not limited to, approximately parallel. The mating face 38 of each contact module is received in the housing 20 and is configured to mate with corresponding mating contacts of the header connector 18.

The mounting face 42 of each of the contact modules 22 is configured for mounting on a circuit board, such as, but not limited to, the circuit board 12. The mounting contacts 30 and 34 extend outward from, and along, the mounting face 42 of the contact modules 22 for mechanical and electrical connection to the circuit board 12. Specifically, each of the mounting contacts 30 and 34 is configured to be received within a corresponding signal via 54 and ground via 56, respectively, within the circuit board 12.

In an exemplary embodiment, the signal terminals 26 extend along a paddle 58 that extends from the mounting face 42 into the circuit board 12. The paddle 58 extends into the signal vias 54. The paddle 58 provides support for the mounting contacts 30. In an exemplary embodiment, the paddle 58 supports both signal terminals 26 within the corresponding pair. The paddle 58 is received in both signal vias 54 that receive the pair of signal terminals 26. Both signal vias 54 are open to one another across the space therebetween and the paddle 58 spans across the space between the signal vias 54. Optionally, the paddle 58 may be integrally formed with the contact module housing 40. For example, the paddle 58 may be overmolded with the contact module housing 40. Alternatively, the paddle 58 may be separate and discrete from the contact module housing 40. For example, the paddle 58 may be separately formed and coupled to the contact module housing 40 or may be free standing independent of the contact module housing 40.

In an exemplary embodiment, the signal terminals 26 constitute variable depth connection terminals, where some of the mounting contacts 30 extend different lengths from the mounting face 42 than others of the mounting contacts 30 (whether the others are on the same contact module 22 or a different contact module 22) to different mating depths. For example, a differential pair 30*a* of the mounting contacts 30 extends to a mating, depth $D_1$ from the mounting face 42, a differential pair 30*b* of the mounting contacts 30 extends to a mating depth $D_2$ from the mounting face 42, and a differential pair 30*c* of the mounting contacts 30 extends to a mating depth $D_3$ from the mounting face 42. The depths $D_1$-$D_3$ are each different. Any of the mounting contacts 30 of the receptacle connector 16 may have a different length, and thus a different mating depth, from the corresponding mounting face 42 than any other mounting contact 30 of the receptacle connector 16. The pattern of the lengths of the mounting contacts 30 shown herein is meant as exemplary only. Optionally, the paddles 58 may be utilized with signal terminals 26 extending to greater depths, such as to depths $D_2$ and $D_3$, but not to signal terminals 26 extending to shallow depths, such as to depth $D_1$. Alternatively, all of the signal terminals 26 may utilize paddles 58.

The header connector 18 includes a dielectric housing 60 that receives the receptacle connector 16 and a mounting face 62 for mounting the header connector 18 to a circuit board, such as, but not limited to, the circuit board 14. The housing 60 holds a plurality of signal terminals 70 and a plurality of ground terminals 72. The signal terminals 70 are optionally arranged in differential pairs, as the signal terminals 70 are shown in the illustrated embodiment.

Each signal terminal 70 includes a mounting contact 74 at one end portion of the signal terminal 70. Each of the mounting contacts 74 is configured to be received within a corresponding signal via 82 within the circuit board 14. Similar to the mounting contacts 30 of the receptacle connector 16, some of the mounting contacts 74 of the signal terminals 70 extend different lengths from the mounting face 62 of the header connector 18 than others of the mounting contacts 74. In an exemplary embodiment; the header connector 18 may include paddles 84, similar to the paddles 58, which extend along the mounting contacts 74 of the signal terminals 70. The paddles 84 extend into the signal vias 82. The paddles 84 may support more than one signal terminal 70, such as signal terminals 70 of each pair, and extend into the corresponding signal vias 82.

The circuit board 12 includes a substrate having a pair of opposite upper and lower surfaces 86 and 88. The mounting face 42 of each of the contact modules 22 is configured to be mounted along the upper surface 86 such that the receptacle connector 16 is mounted on the upper surface 86 of the circuit board 12. The circuit board 12 includes the plurality of signal vias 54 and ground vias 56 that receive the mounting contacts 30 and 34, respectively, of the respective signal and ground terminals 26 and 28.

The circuit board 12 includes intermediate vias 90 between the pair of signal vias 54 that receive the pair of signal terminals 26. The intermediate via 90 and corresponding signal vias 54 define a via set. The intermediate vias 90 may extend entirely through the circuit board 12. In an exemplary embodiment, the intermediate vias 90 are open to both the signal vias 54 within the via set creating a common space that receives the paddle 58.

Some of the signal vias 54 may include a smaller diameter portion 94 and one or more larger diameter portions 96. The smaller diameter portions 94 each include an electrical conductor 98 on a surface 100 defining the smaller diameter portion 94 of the signal via 54. Each electrical conductor 98 defines an electrical contact portion for electrical connection with a corresponding one of the mounting contacts 30 of the signal terminals 26. The electrical conductor 98 of each signal via 54 is electrically connected to a mounting pad 102 and a signal trace (not shown) of the circuit board 12. The electrical conductors 98 of the smaller diameter portions 94 of the signal vias 54 are each electrically connected to a different mounting pad 102 and signal trace on one of the layers of the circuit board 12.

The mounting pad 102 is provided at the end of the signal trace (not shown) and defines the portion of the signal trace that is electrically connected to the electrical conductor 98 and/or the signal terminal 26. The mounting pad 102 may have an increased cross-section as compared to the other portions of the signal trace. The signal via 54 may extend through the mounting pad 102. A portion of the mounting pad 102 may be removed when the signal via 54 is formed.

The electrical conductors 98 of some of the signal vias 54 are located at respective different depths within the corresponding signal via 54 relative to the surface 86 of the circuit board 12. Each electrical conductor 98 may be formed by any suitable method, process, means, and/or the like, such as, but not limited to, plating and/or the like. Each of the signal vias 54 may be formed using any suitable method, process, means, and/or the like. For example, each of the signal vias 54 may be formed by forming an opening within the circuit board 12 to define the surface 100 of the smaller diameter portion 94, forming the electrical conductor 98 on the surface 100, and thereafter boring, through the circuit board 12 to define the larger diameter portion(s) 96. The boring operation will remove the surface 100 and the electrical conductor 98 from the entirety of the signal via 54 except for the smaller diameter portion 94.

The intermediate via 90 is located between the smaller diameter portions 94 of the signal vias 54 within the corresponding via set. The intermediate via 90 is spaced apart from the smaller diameter portions 94. The intermediate via 90 defines an air pocket or void between the electrical conductors 98, which affects the electrical characteristics of the electrical conductors 98. For example, the air pocket may raise the impedance by providing a volume of air between the electrical conductors rather than the circuit board material. When larger diameter portions 96 are created, the larger diameter portions are open to the intermediate via 90. For example, when the larger diameter portions 96 are formed, the circuit board material is removed such that the signal vias 54 are open to the intermediate via 90. A common chamber is thus created, having both signal vias 54 open to one another. The paddle 58 is received in the chamber defined by both signal vias and the intermediate via 90.

When the receptacle connector 16 is mounted on the circuit board 12, the mounting contacts 30 are each received within the corresponding signal via 54, such that the mounting contacts 30 are electrically connected to the respective electrical conductor 98. Some of the mounting contacts 30 of the signal terminals 26 extend different depths, relative to the circuit board surface 86, into the corresponding signal via 54 than others of the mounting contacts 30 (whether the others are on the same contact module 22 or a different contact module 22). Although the mounting contacts 30 are shown herein as press-fit contacts, the mounting contacts 30 may each be any suitable type of electrical contact that enables the mounting contacts 30 to function as described herein.

The circuit board 14 may be formed in a similar manner as the circuit board 12. The header connector 18 is mounted on the circuit board 14 in a similar manner as the receptacle connector 16 being mounted to the circuit board 12.

Figure 2:
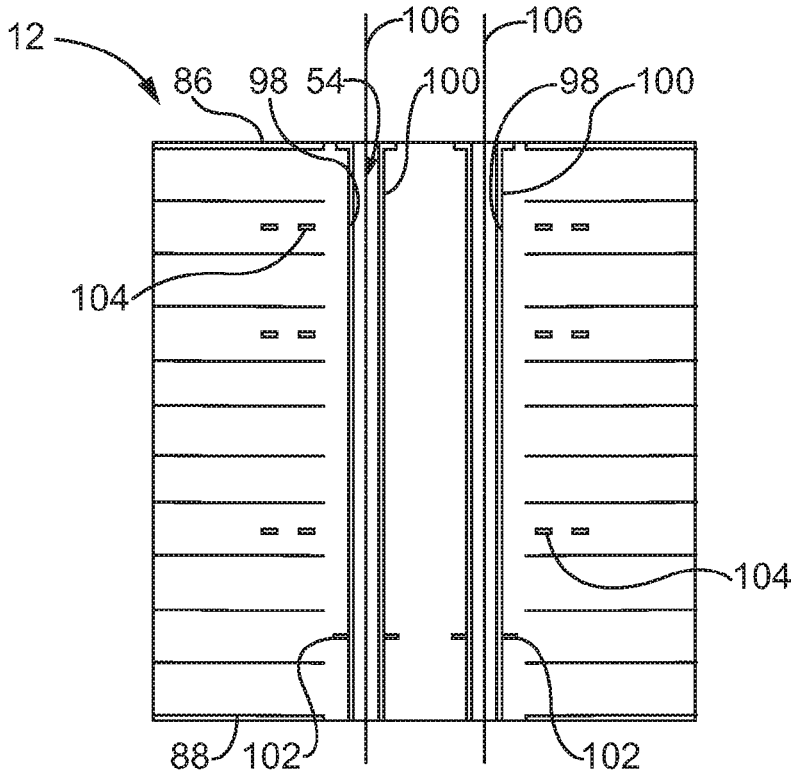
FIG. 2 is a partial cut-away view of one of the circuit boards during one stage of manufacture.

FIG. 2 is a partial cut-away view of the circuit board 12 during one stage of manufacture. The circuit board 12 includes a pair of the signal vias 54 extending through the layers of the circuit board 12 between the top and bottom surfaces 86, 88. The thickness of the circuit board 12 is a function of the number of layers, and the number of layers may depend, at least in part, on the number of components being connected to the circuit board 12. For example, a backplane circuit board may be substantially thicker than a daughtercard circuit board because many more electrical components are connected to the backplane circuit board as compared to the daughtercard circuit board, thus more layers are required to route the traces through the board.

In an exemplary embodiment, the signal vias 54 are formed by boring through the circuit board 12 at predetermined locations, such that the bore passes though corresponding mounting pads 102 in, or on, one of the layers. The mounting pads 102 are connected to corresponding signal traces (not shown) routed through the circuit board 12. The mounting pads 102 define the connection point between the receptacle connector 16 (shown in FIG. 1) and the circuit board 12. Boring through the circuit board 12 forms the surface 100, which is cylindrical and has a specified diameter. The thickness of the circuit board 12 may affect the diameter of the signal vias 54. For example, it is desirable to maintain a certain aspect ratio of circuit board thickness to via diameter in order to facilitate adequate plating of the signal via 54. If the diameters of the signal vias 54 are too small, as compared to the thickness of the circuit board 12, then the signal via 54 cannot be properly plated.

Once the signal vias 54 are bored, the surfaces 100 are plated, thus forming the electrical conductor 98. The plating process deposits a metal surface on the surface 100, which engages the mounting pads 102, thus creating an electrical connection between the mounting pads 102 and the electrical conductors 98. When the mounting contacts 30 (shown in FIG. 1) engage the electrical conductors 98, an electrical path is created between the mounting contacts 30 and the mounting pads 102.

Having the electrical conductors 98 in proximity to other traces 104 routed through the various layers of the circuit board 12 has a negative impact on the electrical performance of the system. For example, signal degradation due to cross-talk between the electrical conductors 98 and the traces 104 may result. The effects of the signal degradation may be impacted by the characteristics of the signals being transmitted by the electrical conductors 98 and/or the traces 104, such as, but not limited to, the signal transmission speed. In an exemplary embodiment, at least a portion of each electrical conductor 98 is removed during a counterboring process to reduce the length of the electrical conductor 98 along a via axis 106 thereof.

Having the electrical conductors 98 in proximity to each other may also affect the electrical characteristics of the signal transmitted through the system. For example, the impedance of the signals may be affected by the spacing of the electrical conductors relative to one another, the lengths of the electrical conductors, the type and amount of material between electrical conductors 98, and the like. In an exemplary embodiment, at least a portion of the material between the electrical conductors 98 is removed during a boring operation or other operation to provide an air pocket between the electrical conductors 98.

Figure 3:
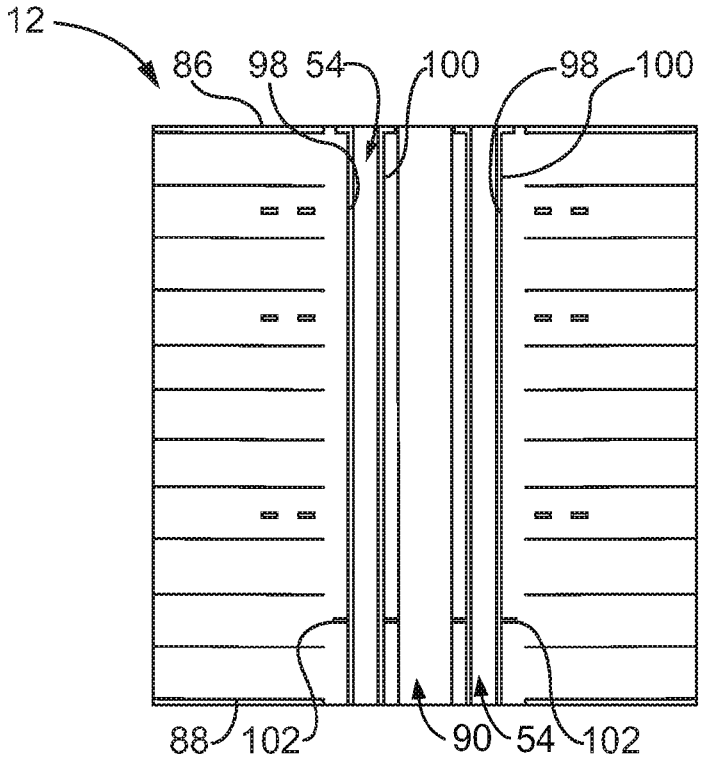
FIG. 3 is a partial cut-away view of the circuit board shown in FIG. 2 during another stage of manufacture.

FIG. 3 is a partial cut-away view of the circuit board 12 during another stage of manufacture after the intermediate via 90 is bored between the signal vias 54. In an exemplary embodiment, the intermediate via 90 is bored entirely through the layers of the circuit board 12 between the top and bottom surfaces 86, 88. Alternatively, the intermediate via 90 is bored only partially through the circuit board 12, such as to a layer below the mounting pads 102 or to a layer above the mounting pads 102. In other alternative embodiments, the intermediate via 90 is formed by a process other than boring, such as laser drilling or other processes.

The intermediate via 90 has a diameter that allows the intermediate via 90 to fit between the signal vias 54. When bored, the walls of the intermediate via 90 are spaced apart from the surface 100 of the signal vias 54. The intermediate via 90 is bored between the mounting pads 102. Optionally, when bored, the drill does not remove any portion of the mounting pads 102. Having the intermediate via 90 introduces air between the electrical conductors 98. The air affects coupling between the electrical conductors 98, such as by raising impedance therebetween.

Figure 4:
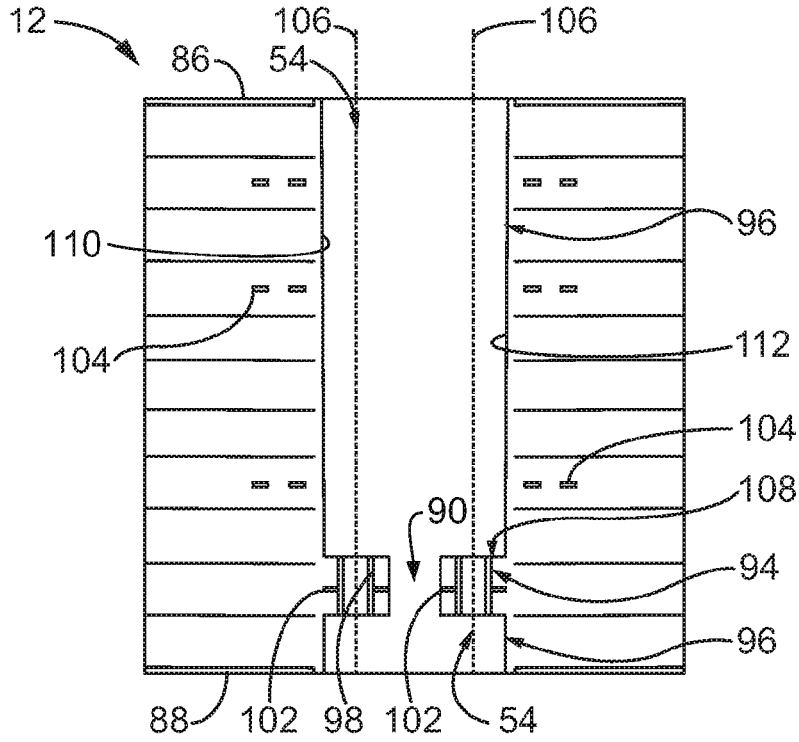
FIG. 4 is a partial cut-away view of the circuit board shown in FIG. 2 during another stage of manufacture.

FIG. 4 is a partial cut-away view of the circuit board 12 during another stage of manufacture after a secondary bore and optional counterbore operation. In the illustrated embodiment, the signal vias 54 are bored from the top surface 86 and optionally counterbored from the bottom surface 88. The signal vias 54 are bored (and counterbored) to the vicinity of the mounting pads 102, leaving a relatively short electrical conductor 98. This secondary boring operation reduces the cross-talk with neighboring traces 104. When the signal vias 54 are bored, the signal vias 54 are opened up into the intermediate via 90, creating a common chamber between the signal vias 54. The signal via 54 is used as a guide for the drill bit during the secondary boring operation to keep the drill aligned with the via axis 106. After the secondary boring operation, the circuit board 12 includes an opening extending from an outer portion 110 of one signal via 54 to an outer portion 112 of the other signal via 54. After the secondary boring operation, the intermediate via 90 remains between the electrical conductors. Such portion of the intermediate via 90 defines an air pocket between the electrical conductors 98. The air affects coupling between the electrical conductors 98, such as by raising impedance therebetween.

Boring from the top surface 86 and counterboring the bottom surface 88 may not be possible for each signal via 54. For example, signal vias 54 having electrical conductors 98 at or near one of the upper layers may not have any boring from the upper surface 86. Similarly, signal vias 54 having electrical conductors 98 at or near one of the bottom layers may not have any counterboring from the lower surface 88.

The secondary boring operation defines the larger diameter portions 96 for each signal via 54. The portion of the signal via 54 not bored defines the smaller diameter portion 94. A shoulder 108 is created at the interface between the upper larger diameter portion 96 and the smaller diameter portion 94. The shoulder 108 extends between the intermediate via 90 and the smaller diameter portion 94. Optionally, the shoulder 108 may be tapered downward toward the via axis 106. In an exemplary embodiment, the diameter of the smaller diameter portion 94 is approximately half the diameter of the larger diameter portion 96. Having a large diameter for the larger diameter portions 96 introduces air in the signal via 54 along the via axis 106 around the signal terminal 26 (shown in FIG. 1). The air affects interpair and intrapair coupling as described in further detail below, such as by lowering cross-talk with neighboring traces 104 and/or raising impedance of the signal terminals 26. The diameter of the larger diameter portion 96 may be restricted by other components of the circuit board 12, such as the proximity of neighboring traces 104 to the signal vias 54 and/or the spacing between the signal vias 54 themselves.

Figure 6:
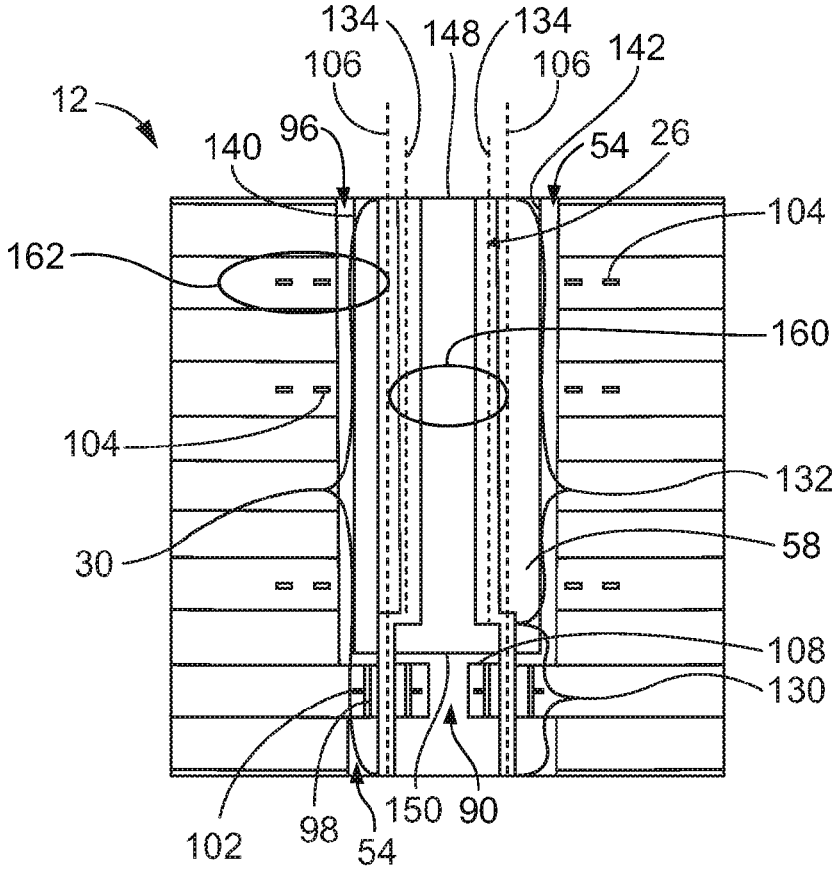
FIG. 6 is a side view of the circuit board and signal terminals.
Figure 5:
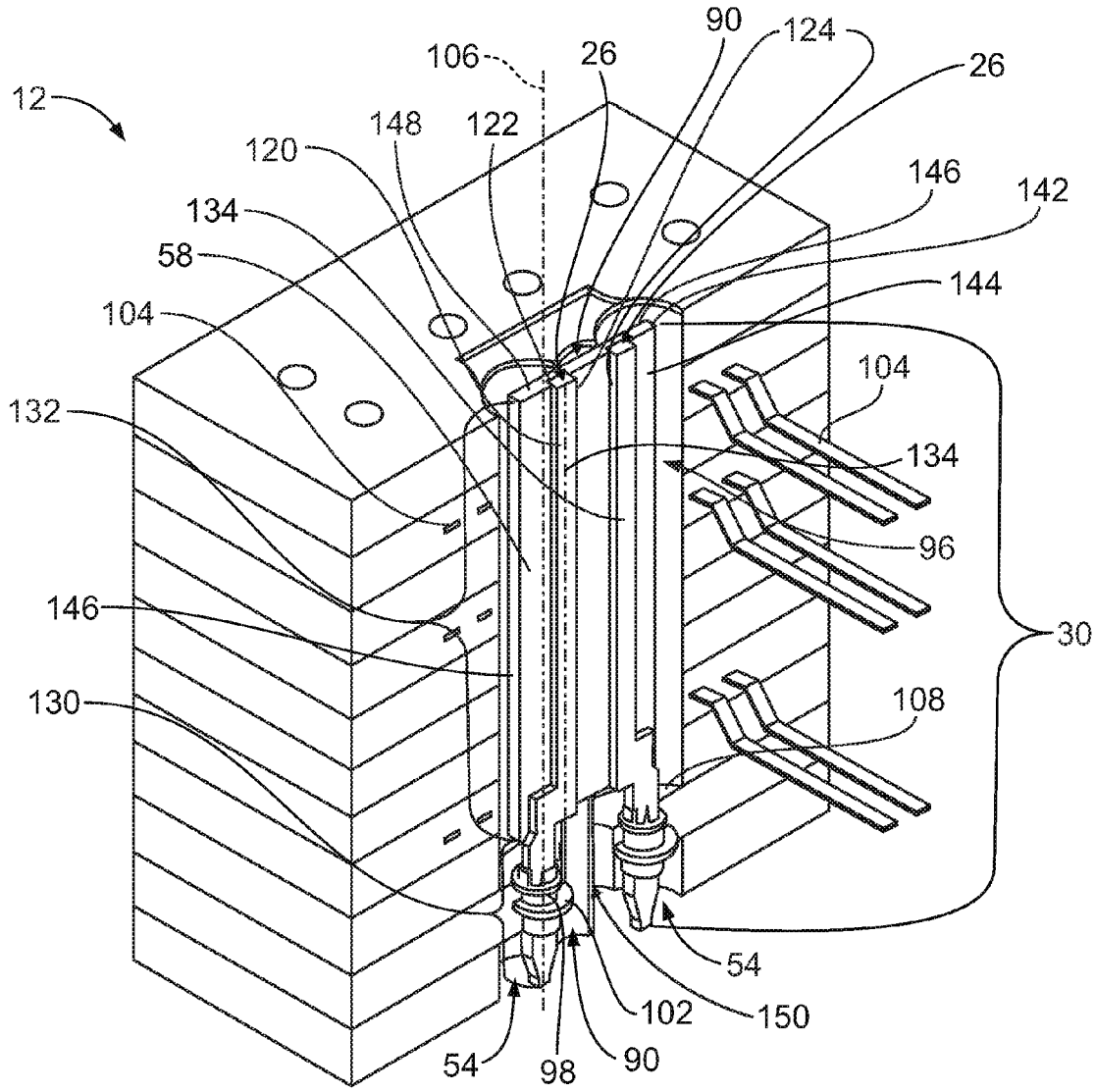
FIG. 5 is a partial cut-away view of the circuit board shown in FIG. 2 illustrating signal terminals mounted to the circuit board.

FIG. 5 is a partial cut-away view of the circuit board 12 illustrating the signal terminals 26 connected to the circuit board 12. FIG. 6 is a side view of the circuit board 12 and signal terminals 26. The mounting contacts 30 of the signal terminals 26 are the only portions of the signal terminals 26 illustrated in FIGS. 5 and 6.

The mounting contacts 30 form part of the lead frame 24 (shown in FIG. 1), and are formed integral with the signal terminals 26 thereof. In an exemplary embodiment, the lead frame 24 is stamped and formed to define the signal terminals 26. When stamped, the signal terminals 26 are separated from one another and are generally co-planar with one another. The planar sides of the stock of material used to form the lead frame 24 define a first side 120 and a second side 122 (both shown in FIG. 5) of the signal terminals 26, which are parallel to one another. Cut sides 124 (shown in FIG. 5) extend between the first and second sides 120, 122, which are defined during the stamping process by shearing off the unused stock material. The individual signal terminals 26 may then be formed by bending, folding or otherwise manipulating the signal terminals 26 to give the signal terminals 26 a final shape. Once formed, the first and second sides 120, 122 may not necessarily be parallel to one another.

The mounting contacts 30 are the portions of the signal terminals 26 extending from the mounting face 42 of the contact modules 22 (both shown in FIG. 1). The mounting contacts 30 extend along the paddle 58. The mounting contacts 30 may be embedded within the paddle 58. Optionally, the first sides 120 of the mounting contacts 30 are exposed and/or extend beyond the paddle 58. Alternatively, the mounting contacts 30 may be entirely encased within the paddle 58 for the length of the paddle 58. The paddle 58 and mounting contacts 30 are received within the signal vias 54 and/or intermediate via 90.

In an exemplary embodiment, the paddle 58 is a generally planar, plate-like structure. The paddle 58 includes opposite edges 140, 142 and opposite sides 144, 146. The signal terminals 26 extend along the side 144, however the signal terminals 26 may extend along the side 146 in addition to, or in the alternative to, the side 144. In an alternative embodiment, rather than extending along the sides 144 and/or 146, the signal terminals 26 may be embedded within the paddle 58, such that the first and second sides 120, 122 of the signal terminals 26 are positioned interior of the sides 144, 146 of the paddle 58. In alternative embodiments, the paddle 58 may have other shapes other than a rectangular plate-like shape. For example, the paddle may include cylindrical portions surrounding the mounting portions 30.

The paddle 58 includes a top 148 and a bottom 150 and has a length defined between the top 148 and bottom 150. The length of the paddle 58 may depend on the length of the corresponding signal terminals 26 and the depth into the circuit board 12 to which the signal terminals 26 need to extend. The bottom 150 is loaded into the signal vias 54 and intermediate via 90 until the bottom 150 engages the shoulder 108. The shoulder 108 defines a stop to limit insertion of the paddle 58, and thus the signal terminals 26, into the circuit board 12. Alternatively, the bottom 150 may be spaced apart from the shoulder 108 in the final loaded position.

The top 148 extends from the dielectric contact module housing 40 (shown in FIG. 1). Optionally, the paddle 58 may be integrally formed with the dielectric contact module housing 40. The paddle 58 may be manufactured from the same material as the dielectric contact module housing 40. Alternatively, the paddle 58 may be manufactured from a different material than the dielectric contact module housing 40. In an exemplary embodiment, the paddle 58 is manufactured from a dielectric material, such as a plastic material. For example, the paddle 58 may be manufactured from a liquid crystal polymer, an air filled polytetrafluoroethylene (PTFE) material, or another dielectric material. The type of material and/or the size of the paddle 58 may be selected to control electrical characteristics of the signal contacts 26. The type of material and/or the size of the paddle 58 may be selected to withstand the insertion forces of the receptacle connector 16 during mounting of the receptacle connector 16 to the circuit board 12. The paddle 58 adds strength to the mounting contacts 30 for loading the mounting contacts 30 into the signal vias 54. The paddle 58 may resist buckling of the mounting contacts 30 by holding the mounting contacts 30 in position during mounting to the circuit board 12.

The mounting contacts 30 include a mounting portion 130 and a transition portion 132. The mounting portion 130 engages the electrical conductor 98, and is thus electrically connected to the mounting pad 102 within the corresponding signal via 54. In the illustrated embodiment, the mounting portion 130 is represented by an eye-of-the-needle contact. Other types of mounting portions 130 may be utilized in alternative embodiments, such as compression contacts, spring contacts, solder balls, blade contacts configured to make direct contact with the mounting pad 102 by slicing through the circuit board 12 and mounting pad 102, and the like. The length of the mounting portion 130 is slightly longer than the electrical conductor 98 to ensure electrical contact thereto. The mounting portion 130 of the mounting contact 30 extends beyond the paddle 58 for connection to the electrical conductor 98.

The transition portion 132 extends between the mounting face 42 and the mounting portion 130. The transition portion 132 extends along the paddle 58. In an exemplary embodiment, the transition portion 132 is generally offset with respect to the mounting portion 130. For example, the transition portions 132 of the pair of signal terminals 26 are offset toward one another relative to the mounting portions 130. The amount of offset is established to control the impedance of the signal terminals 26 and/or cross-talk between the signal terminals 26 and neighboring traces 104. In the illustrated embodiment, the transition portions 132 are offset away from the neighboring traces 104, such as to reduce cross-talk between the signal terminals 26 and the neighboring traces 104. The transition portions 132 are offset toward one another, such as to decrease impedance of the signal terminals 26. The decrease in impedance may be necessary due to the large amount of air introduced by the large bore of the signal via 54 and/or the intermediate via 90.

The larger diameter portions 96 of the signal vias 54 and/or the intermediate via 90 provide space for the transition portions 132 to be offset from the via axes 106. For example, while the mounting portions 130 are aligned with the via axes 106, parts of the transition portions 132 are aligned vertically above the shoulder 108, which would not be possible without the oversized counterboring process, and/or aligned within the intermediate via 90. In an exemplary embodiment, the larger diameter portions 96 and intermediate via 90 are filled with air, which has a dielectric constant of approximately 1.0, as opposed to the material of the circuit board 12, which may be FR-4 having a dielectric constant of approximately 4.3. The air surrounding the mounting contacts 30 affects the electrical characteristics of the mounting contacts 30, such as by affecting the interactions between the adjacent mounting contacts 30 and/or by affecting the interactions between the mounting contacts 30 and the neighboring traces 104.

In an exemplary embodiment, the signal terminals 26 define signal propagation paths through the circuit board 12, and the signal terminals 26 are oriented such that the signal terminals 26 are offset from the via axes 106 along a majority of the signal propagation paths. The signal terminals 26 each have a terminal axis 134 defined at a cross-sectional center of the signal terminals 26 along the length of the signal terminals 26. The cross-sectional center is the center of gravity of the signal terminal 26 along any given cross-section taken along the length of the signal terminal 26. The length of the signal terminal 26 is defined as the longitudinal length of the signal terminal 26 (e.g. between the mounting contact 30 and the mating contact 32 (shown in FIG. 1)). The terminal axes 134 of the signal terminals 26 of each pair are offset with respect to the corresponding via axes 106 along a majority of the signal terminals 26 within the signal vias 54. Optionally, the terminal axes 134 along the mounting portions 130 are generally coincident with the via axes 106, while the terminal axes 134 along the transition portions 132 are non-coincident with the via axes 106. The terminal axes 134 of the transition portions 132 are offset with respect to the terminal axes 134 of the mounting portions 130. The amount of offset is selected to control the electrical characteristics of the signal terminals 26.

Intrapair and interpair interactions can be understood with reference to FIG. 6, which illustrates an intrapair interaction zone 160 and an interpair interaction zone 162. The intrapair interaction zone 160 is generally provided between the signal terminals 26 within a differential pair. The interpair interaction zone 162 is generally provided between the signal terminals 26 and the neighboring traces 104. With the addition of the intermediate via 90 and/or the counterboring of the plating and surrounding material of the circuit board 12 down to the vicinity of the mounting pads 102, a large air gap is provided around each signal terminal 26. The large air gap affects the intrapair coupling in the intrapair interaction zone 160, such as by raising the impedance. However, depending on the diameter of the bore, the air gap may raise the impedance above the desired level (e.g. 100 Ohms), which may cause signal degradation. By having the transition portions 132 shifted toward one another, the impedance may be lowered to the desired level (e.g. 100 Ohms, however other levels are possible in alternative embodiments depending on the particular application). The shape of the mounting contacts 30, particularly in the transition portions 132, may be selected to obtain the desired impedance. As such, intrapair coupling in the intrapair interaction zone 160 may be controlled by selecting the shape and spacing of the mounting contacts 30 within each differential pair.

The electrical characteristics of the signal terminals 26 may be affected by having the paddle 58 positioned between and/or along the mounting contacts 30. The type of material used for the paddle 58, the amount of paddle material provided between the signal terminals 26, the length of the paddle 58 and other physical attributes and characteristics may be selected to control the electrical characteristics of the signal terminals 26, such as by controlling the amount of intrapair coupling.

With the counterboring of the plating down to the vicinity of the mounting pads 102, a large air gap is provided around each signal terminal 26. The large air gap affects the interpair coupling in the interpair interaction zone 162, such as by lowering trace-to-terminal crosstalk. The introduction of air between the traces 104 and the mounting contacts 30 helps reduce crosstalk therebetween because air has a lower dielectric constant than the circuit board 12 material. Additionally, by having the transition portions 132 shifted away from the traces 104, the trace-to-terminal crosstalk may be further reduced as compared to a situation in which the transition portions 132 were not shifted. As such, interpair coupling in the interpair interaction zone 162 may be controlled by orienting each mounting contact 30 in a particular location relative to the neighboring traces 104. Furthermore, by having the cut sides 124 (shown in FIG. 5) facing the neighboring traces 104, as opposed to the first and second sides 120, 122 (shown in FIG. 5), a narrower portion of the signal terminals 26 faces the neighboring traces 104, which may also reduce trace-to-terminal cross-talk.

In the illustrated embodiment, the mounting contacts 30 are stamped and formed in a predetermined manner to provide predetermined electrical characteristics. For example, the mounting contacts 30 are formed and positioned with respect to one another and the neighboring traces 104 to control impedance between the signal traces 26 of the differential pair and to control cross-talk with neighboring traces 104. Having the mounting contacts 30 supported by the paddle 58 allows the mounting contacts 30 to be made smaller as the loading forces are imparted onto the paddle 58 rather than the mounting contacts 30. For example, the paddle 58 provides rigidity to the mounting contacts 30 during mounting of the receptacle connector 16 to the circuit board 12. Having smaller mounting contacts 30 allows for more controlled placement of the mounting contacts 30, as well as, less coupling with the neighboring traces 104, which affects the overall electrical performance of the system. In an exemplary embodiment, the mounting contacts 30 are stamped with the centerlines of the transition portions 132 being non-coincident with the centerlines of the mounting portions 130. The centerlines are staggered or shifted with respect to one another such that the transition portions 132 of the signal terminals 26 within each pair are shifted toward one another with respect to the mounting portions 130 of the signal terminals 26 within each pair.

The embodiments described and/or illustrated herein provide an electrical connector that may enable improvement of the density and/or electrical performance of circuit board footprints to achieve higher system densities and/or higher system speeds. For example, the embodiments described and/or illustrated herein, when left at the same density as at least some known systems, may decrease via to via coupling and may increase circuit board footprint impedance. Alternatively, the embodiments described and/or illustrated herein may be able to achieve higher footprint densities than at least some known systems while maintaining the same via to via coupling and impedance levels of such known systems. The embodiments described and/or illustrated herein may provide improved electrical characteristics between signal terminals of the electrical connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a circuit board comprising signal vias extending at least partially through the circuit board, the signal vias being arranged in pairs, the pair of signal vias being open to one another through the circuit board, the circuit board having mounting pads exposed within the signal vias; and an electrical connector mounted on the circuit board, the electrical connector comprising signal terminals extending into respective signal vias of the circuit board and being terminated to corresponding mounting pads, the signal terminals being arranged in pairs carrying differential pair signals, the pair of signal terminals being arranged along a paddle supporting the signal terminals, the paddle being received in both signal vias of the corresponding pair of signal vias.

2. The assembly of claim 1, wherein the paddle defines a plate having opposite edges and opposite sides, the signal terminals extending along at least one of the sides.

3. The assembly of claim 1, wherein the paddle is overmolded over the signal terminals.

4. The assembly of claim 1, wherein the signal vias extend along via axes, the paddle having opposite edges positioned outside of the via axes.

5. The assembly of claim 1, wherein the circuit board includes intermediate vias extending at least partially through the circuit board, the intermediate vias being positioned between the signal vias within a corresponding pair, the intermediate via being open to both signal vias within the corresponding pair of signal vias, the paddle extending through the intermediate via.

6. The assembly of claim 1, wherein the paddle extends through a majority of the circuit board.

7. The assembly of claim 1, wherein the signal vias include smaller diameter portions and larger diameter portions with a shoulder defined between the smaller and larger diameter portions, the smaller diameter portions being plated and being electrically connected to the corresponding mounting pad, the signal terminals having transition portions being arranged within the larger diameter portions and being aligned vertically above the shoulder.

8. The assembly of claim 1, wherein the signal terminals comprise variable depth signal terminals configured to extend different depths into respective vias of the circuit board, the signal terminals of each pair extending to the same depth in the respective vias of the circuit board.

9. The assembly of claim 1, wherein the signal terminals have terminal axes, wherein the terminal axes of the signal terminals of each pair are offset with respect to via axes of the corresponding signal vias along a majority of the signal terminals within the vias.

10. The assembly of claim 1, wherein the signal terminals include a mounting portion and a transition portion, the signal terminals have terminal axes along the mounting portions being coincident with via axes of the corresponding signal vias, the terminal axes along the transition portions being non-coincident with the via axes.

11. An electrical connector assembly comprising:

a circuit board comprising signal vias extending at least partially through the circuit board, the signal vias being arranged in pairs, the circuit board having intermediate vias extending at least partially through the circuit board, the intermediate vias being positioned between the signal vias within a corresponding pair, the intermediate via being open to both signal vias within the corresponding pair of signal vias, the pair of signal vias and the corresponding intermediate via defining a via set, the circuit board having mounting pads exposed within the signal vias; and an electrical connector mounted on the circuit board, the electrical connector comprising signal terminals extending into respective signal vias of the circuit board and being terminated to corresponding mounting pads, the signal terminals being arranged in pairs carrying differential pair signals, the pair of signal terminals being arranged along a paddle supporting the signal terminals, the paddle being received in both signal vias and the intermediate via of the corresponding via set.

12. The assembly of claim 11, wherein the signal vias include smaller diameter portions and larger diameter portions with a shoulder defined between the smaller and larger diameter portions, the smaller diameter portions being plated and being electrically connected to the corresponding mounting pad, the intermediate via being positioned between, and being spaced apart from, the smaller diameter portions of the signal vias within the corresponding pair, the intermediate via being open to the larger diameter portions of the signal vias within the corresponding pair.

13. The assembly of claim 11, wherein the paddle defines a plate having opposite edges and opposite sides, the signal terminals extending along at least one of the sides.

14. The assembly of claim 11, wherein the signal vias extend along via axes, the paddle having opposite edges positioned outside of the via axes.

15. An electrical connector assembly comprising:

a circuit board comprising signal vias extending at least partially through the circuit board, the signal vias being arranged in pairs, the signal vias having plated sections, the circuit board having mounting pads electrically connected to the plated sections;

the circuit board having intermediate vias extending at least partially through the circuit board, wherein the intermediate vias are positioned between the signal vias within a corresponding pair, the intermediate via providing an air pocket between the plated sections of the signal vias within the corresponding pair of signal vias.

16. The assembly of claim 15, wherein the intermediate vias are spaced apart from the plated sections.

17. The assembly of claim 15, wherein the intermediate vias extend entirely through the circuit board.

18. The assembly of claim 15, wherein the signal vias include smaller diameter portions and larger diameter portions with a shoulder defined between the smaller and larger diameter portions, the plated sections extending along the smaller diameter portions, the intermediate via being open to the larger diameter portions of the signal vias within the corresponding pair.

19. The assembly of claim 15, wherein the signal vias are counterbored from a top of the circuit board to a depth immediately above the mounting pad, the counterboring creating an opening between the signal vias and the intermediate via.

20. The assembly of claim 15, wherein the signal vias are initially bored and plated, the intermediate via being bored in a location between the signal vias either before, at the same time or after the signal vias are bored, and the signal vias being counterbored to a predetermined depth after the intermediate via is bored, the counterboring of the signal vias opening the signal vias to the intermediate via.

* * * * *